United States Patent [19]

Richard

[11] 3,944,040

[45] Mar. 16, 1976

[54] APPARATUS FOR FACILITATING PICK UP OF DRY CLEANING

[75] Inventor: Laurie Richard, Don Mills, Canada

[73] Assignee: Raymond Lee Organization Inc.; a part interest

[22] Filed: June 20, 1974

[21] Appl. No.: 481,247

[52] U.S. Cl. ..... 194/65; 292/169.18; 70/144

[51] Int. Cl.[2] ..... G07F 5/26

[58] Field of Search..... 194/1 A, 1 B, 61, 65, 74, 194/92, 59, 51; 70/144, 156, 157; 292/150, 169.18, 333

[56] References Cited

UNITED STATES PATENTS

| | | | |
|---|---|---|---|
| 774,823 | 11/1904 | Birkedal | 194/51 |
| 948,295 | 2/1910 | Kopal | 194/65 |
| 1,403,128 | 1/1922 | Segal | 292/169.18 |
| 2,221,082 | 11/1940 | Fitzgerald | 70/144 |
| 3,037,605 | 6/1962 | Stackhouse | 194/92 |
| 3,050,169 | 8/1962 | Stackhouse | 194/92 |

FOREIGN PATENTS OR APPLICATIONS

| | | | |
|---|---|---|---|
| 1,376,716 | 9/1964 | France | 70/144 |

*Primary Examiner*—Robert B. Reeves
*Assistant Examiner*—H. Grant Skaggs

[57] ABSTRACT

Apparatus used to facilitate pick up of dry cleaning which uses a multi-drawered cabinet with each drawer having a separate access door. The door is unlocked when a coin is deposited therein and thereafter when closed is locked. A key operated device enables the door once locked to be unlocked and the coin removed. The user after opening the door using the coin places the material for dry cleaning in the cabinet and then locks the door. The person making the pick up opens the door with a key, removes the coin and also removes material from the drawer for cleaning.

2 Claims, 5 Drawing Figures

FIG. 3
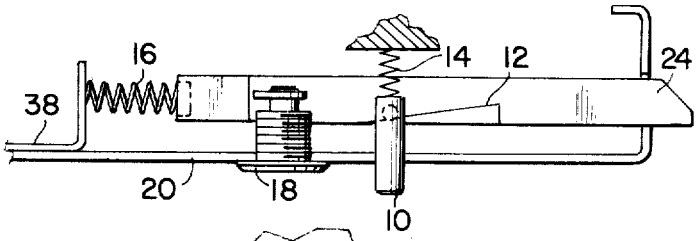
FIG. 1
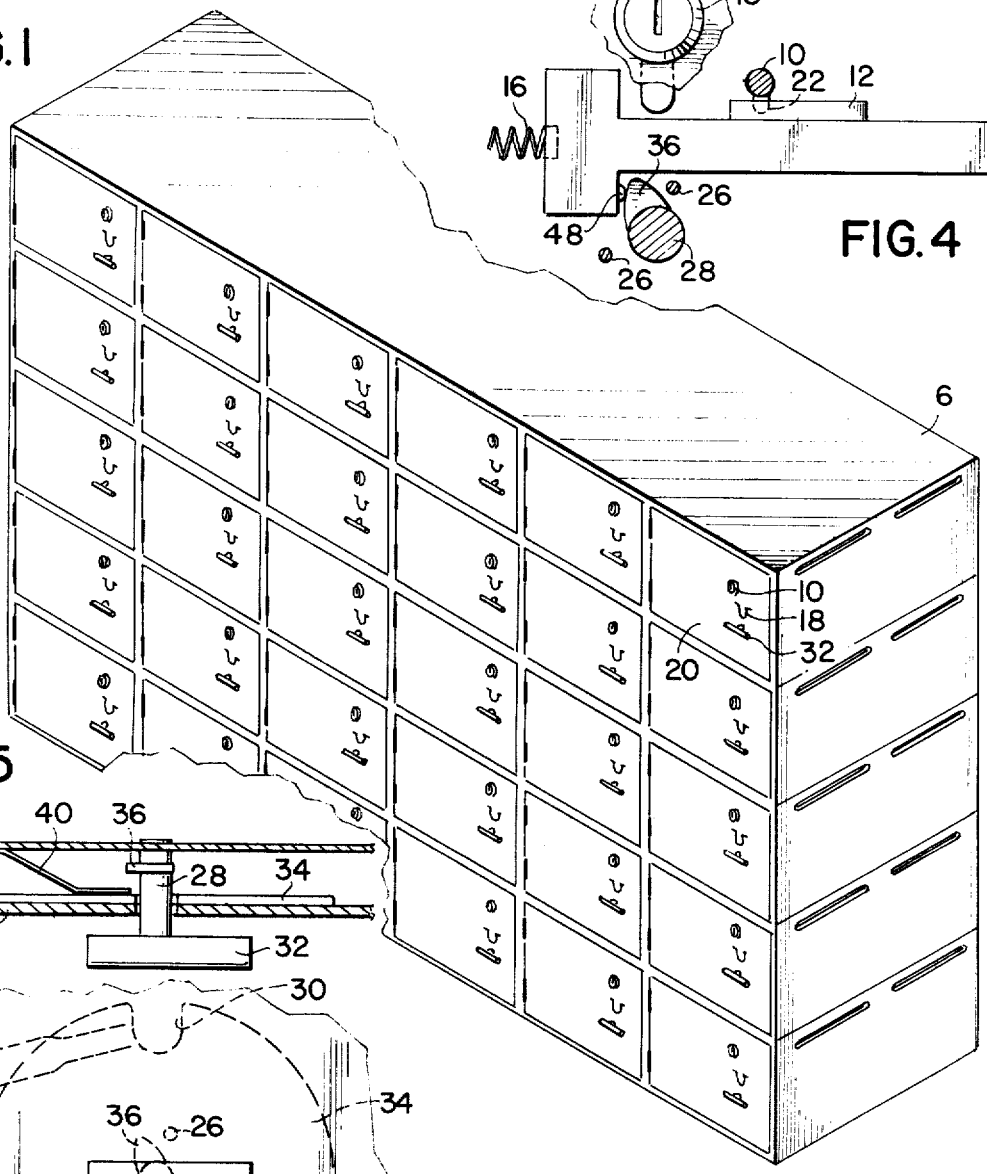
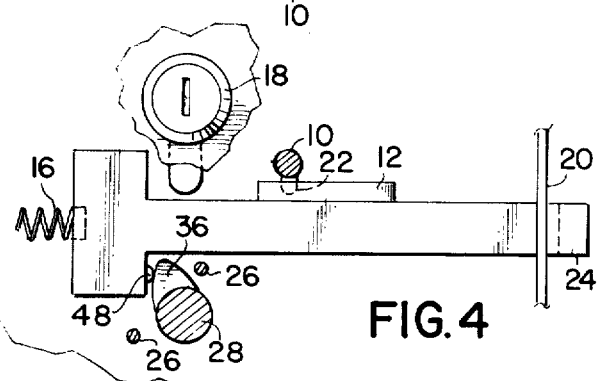
FIG. 4
FIG. 5
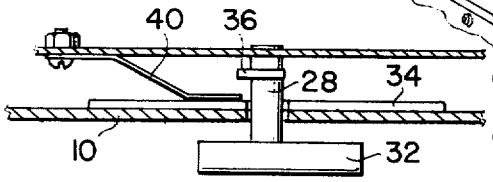
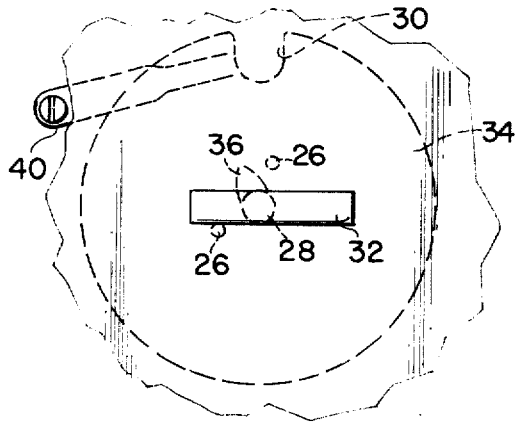
FIG. 2

APPARATUS FOR FACILITATING PICK UP OF DRY CLEANING

SUMMARY OF THE INVENTION

Clothing to be dry cleaned, washed or the like is difficult to deliver to the cleaner or laundry and equally difficult to return.

In this invention, a multi-drawered cabinet is provided with each drawer having a separate access door. A user will deposit the clothing in a drawer and an operator can pick up the material in the drawer, arrange for the cleaning or laundering, and thereafter arrange for delivery to the user as desired.

A mechanism in each door allows the user by depositing a coin to open the door whereby the clothing can be inserted. The door then closed is automatically locked. The door can only be opened by using a key to unlock the door whereby the coin can be removed and the clothing also removed for the purposes indicated.

BRIEF DESCRIPTION OF THE DRAWINGS

In the drawings:

FIG. 1 is a perspective view of the invention;

FIG. 2 is a detail top view of the key operated portion of the mechanism used in the invention;

FIG. 3 is a side view of the structure of FIG. 2;

FIG. 4 is a detail front view of the coin operated portion of the mechanism; and FIG. 5 is a top view of the structure of FIG. 4.

DETAILED DESCRIPTION OF PREFERRED EMBODIMENTS

Referring now to FIGS. 1–5, a multi drawered cabinet 6 has thirty individual drawers arranged in six vertical columns and five horizontal rows, each drawer having a front disposed rectangular access door 20 hinged along a vertical edge to a side wall of the drawer whereby the door remains vertical when open or closed as well as when being opened or closed.

Each door has a key operated lock 18 operating latch 24 as well as a vertical coin wheel 34 having a coin slot 30 and secured at its center to a horizontal axle 28. An external handle 32 is secured to the axle and can be manually operated to rotate the wheel.

Axle 28 carries vertical cam 36 which can bear against return check 48 on the latch. Horizontal return spring 16 is disposed between the inner end of the latch and a bracket 38 on the door. Cam 36 is limited in movement by stop pins 26.

A push to lock and release button 10 spring loaded by return spring 14 cooperates with cam wedge 12 on latch 24 by controlling cam follower 22.

Spring loaded stop 40 cooperates with cam 36 to control the movement of the coin wheel.

Initially, the door is locked. When a coin (for example a ten cent piece) is dropped into the slot, the handle can be turned to rotate the wheel counterclockwise to move the slot out of position for access and cam 36 bears against check 28 and moves same back until the bias of spring 16 is overcome and the latch is unlatched. The door is unlocked and remains unlocked until button 10 is depressed and the door is closed. At this time the door will be fully locked. Note that as latch 24 is forced back against spring 16 cam follower 22 rides over wedge 12. When the latch 24 has been pushed back to a position at which the butt end of wedge 12 bears against cam follower 22, spring 14 forces button 10 outward. Follower 22 then prevents latch 24 from being moved forward to locked position. However when the button is depressed, follower 22 is pushed away from the wedge and spring 16 will push the latch to its forward locked position. The locked door can always be opened by inserting a key into lock 18 and turning the key. This enables the user to rotate the handle as if a coin were disposed in the slot whereby the entire sequence described above can be repeated.

While I have described my invention with particular reference to the drawings, such is not to be considered as limiting its actual scope.

Having thus described this invention, what is asserted as new is:

1. In apparatus used to facilitate pick up of dry cleaning, wash and the like, a multi-drawered cabinet, each drawer having a separate access door which can be opened and closed while always remaining in vertical position, each door having a side opening for receiving a latch, each door being provided with a separate mechanism for unlocking and locking the door, each mechanism comprising:

a horizontally elongated latch which can be moved horizontally forward to engage the corresponding side opening to lock the corresponding door and which can be moved horizontally rearward to be withdrawn from said side opening to unlock said door;

spring means bearing against the latch to normally bias the latch into forward position;

a horizontal shaft rotatable about its axis and extending past the latch at right angles thereto;

a vertical cam on said shaft which is pivoted about the shaft in a vertical plane when the shaft rotates;

a check on the latch disposed on one side of the cam;

stop pins disposed on both sides of the cam and spaced therefrom;

a cam wedge on the latch;

a push-button device having a cam follower cooperating with the wedge, said device including a button spring loaded biased into a normally extended position, said button having a compressed position when manual pressure on the button overcomes the spring bias thereon, said follower bearing against the wedge surface when the button is in extended position and being spaced from the wedge surface when the button is in compressed position; and handle means manually operable and secured to the shaft for rotating the shaft in one direction until the cam bears against the check and moves the latch rearward against the bias of the spring means until the cam bears against one pin to withdraw the latch from the side opening, said handle means rotating the shaft in the opposite direction until the cam bears against the other pin and no longer overcomes the bias of the spring means.

2. The mechanism of claim 1 further including a vertical coin wheel having a coin slot and secured at its center to the shaft, said wheel being perpendicular to the shaft and rotatable therewith.

* * * * *